US005086606A

United States Patent [19]

Finses

[11] Patent Number: 5,086,606

[45] Date of Patent: Feb. 11, 1992

[54] OFFICE PANEL PARTITION AND FRAME THEREFORE

[75] Inventor: Gregory R. Finses, Green Bay, Wis.

[73] Assignee: Krueger International, Inc., Green Bay, Wis.

[21] Appl. No.: 658,060

[22] Filed: Feb. 20, 1991

[51] Int. Cl.[5] ..... A47G 5/00

[52] U.S. Cl. ..... 52/794; 52/239; 52/657

[58] Field of Search ..... 52/656, 657, 239, 794

[56] References Cited

U.S. PATENT DOCUMENTS

| | | | |
|---|---|---|---|
| 2,810,460 | 10/1957 | Winnan | 52/657 |
| 3,605,851 | 9/1971 | Miles et al. | 52/239 |
| 3,768,222 | 10/1973 | Birum, Jr. | 52/239 |
| 4,084,367 | 4/1978 | Saylor et al. | 52/145 |
| 4,112,643 | 9/1978 | Decker | 52/222 |
| 4,891,922 | 1/1990 | Hozer et al. | 52/239 |

*Primary Examiner*—Richard E. Chilcot, Jr.
*Assistant Examiner*—Wynn Wood
*Attorney, Agent, or Firm*—Fuller, Ryan & Hohenfeldt

[57] ABSTRACT

An acoustical divider panel and a frame for such panel are provided in which top and bottom frame members of equal length and opposed side frame members of equal length are joined at their ends by a miter joint to form a rectangular frame. Each of the four members are formed of a U-shaped channel opening outwardly from the frame and each of the edges of said channels are provided with an outwardly facing grooved channel extending along its length for receiving the edges of a sheet of fabric. The interior of the grooved channels contain an undercut portion adapted to secure the edges of said fabric and welting. The frame is preferably formed with one of the frame members at each of said miter joints having an extended outer edge, whereby the amount of offset between said adjoining members can be adjusted.

14 Claims, 2 Drawing Sheets

OFFICE PANEL PARTITION AND FRAME THEREFORE

FIELD OF THE INVENTION

This invention relates to office privacy partition panels and frames for such panels. More specifically, the invention relates to such panels which utilize a metal frame within the perimeters of which sound deadening material is positioned and over the exterior of which frame a fabric or other surface material is fastened.

BACKGROUND ART

Privacy panels are used extensively in offices and other areas such as lounge areas, hospitals, restaurants, or the like. Many such screens are used for their sound absorbing characteristics. Such partitions are generally less than floor to ceiling height and are used as a readily movable substitute for permanent walls in buildings.

A fabric or similar covering is generally applied over the exterior of the panels in order to make easy replacement or cleaning possible. One configuration for such panels is shown in U.S. Pat. No. 3,768,222 issued to Birum, Jr. on Oct. 30, 1973. The panels disclosed in that patent include a metallic frame forming a perimeter for the panel within which perimeter is positioned a layer of sound deadening material such as fiberglass which is secured in place by a spot welded layer of expanded metal grid. A fabric facing layer is the other shown to be attached to the perimeter of the frame members by two-sided pressure sensitive adhesive tape. Appropriate perimeter moldings are conventionally positioned over the top and over sides of the panels to provide a decorative edge surface. Alternative panel structures are shown in U.S. Pat. No. 3,605,851 issued to Miles et al. on Sept. 20, 1971 and U.S. Pat. No. 4,084,367 issued to Saylor et al. on Apr. 18, 1978.

It is an object of the present invention to provide a design for divider partition panels and frames therefore which can be produced at a reduced cost. A related object is to provide such a design in which the frame members can be formed by cold rolling sheet metal such as steel. A further object is to provide frame members which are provided at one end with a preformed radius on each corner to provide frames which lack any sharp corner that would tear the fabric covering or cause injury to persons inadvertently bumping into the corners of the partition panels. A related object is to provide such a frame with a corner configuration that is layered together in such a fashion as to permit adjustment to overcome small tolerance variations in the frame member length without creating an unacceptable offset of frame members in each corner. Yet another object is to provide a panel frame which can readily be assembled by resistance spot welding to provide a frame that while inexpensive, possesses good torsional strength.

A still further object is to provide a frame in which each side of the perimeter is provided with grooves into which the edges of the facing fabric can readily be applied. The fabric, and welting is retained in place by an undercut formed along the length of the grooves. A related object is to provide such an undercut which is readily provided by roll forming a hem of metal which extends partially into the depth of the welting grooves. Further objects and advantages will be apparent to those skilled in the art.

Briefly summarized, the invention provides an acoustical divider panel and a frame for such panel in which top and bottom frame members of equal length, and opposed side frame members of equal length, are joined at their ends by a miter joint to form a rectangular frame. Each of the four members are formed of a U-shaped channel opening outwardly from the frame and each of the edges of the channels are provided with an outwardly facing grooves extending along its length for receiving the edges of a sheet of fabric. The grooves contain an interior undercut portion adapted to secure the edges of said fabric and welting. The frame is preferably formed with one of the abutting frame members at each of said miter joints having an extended outer edge, whereby the amount of offset between said adjoining members can be adjusted.

The frame can be covered with a further layer of sound absorbing material such as fiberglass and then covered on each side by a facia fabric secured at its edges in the groove. A perimeter cap of conventional design and a suitable base or supporting legs are used to complete the installation.

DRAWINGS

The invention will be further explained with reference to the following detailed description and accompanying drawings wherein.

DETAILED DESCRIPTION

Figure 3:
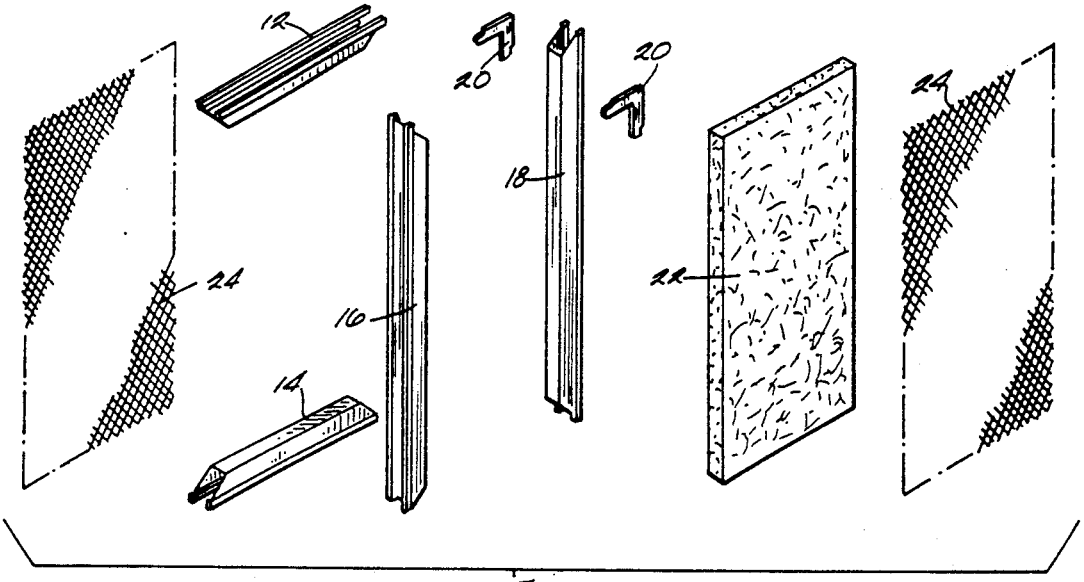
FIG. 3 is a view showing the knocked down elements of the frame shown in FIG. 1.
Figure 1:
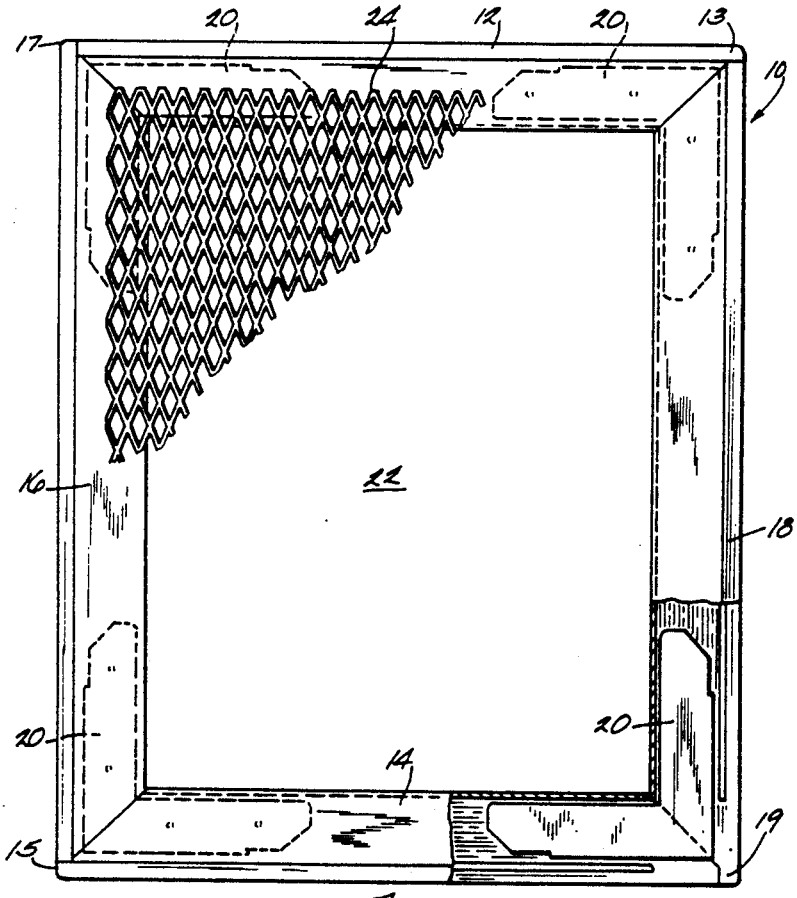
FIG. 1 is a side plan view of a panel frame assembly of the present invention with a portion of the expanded metal grid broken away.
Figure 2:
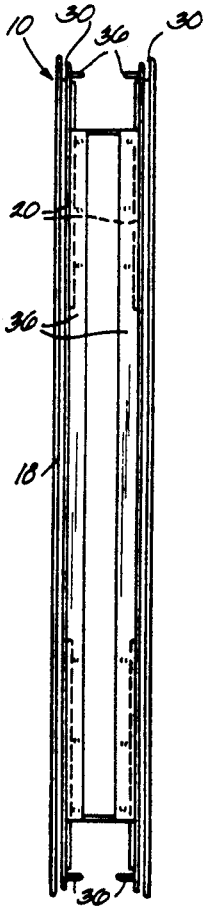
FIG. 2 is a edge view of the panel of FIG. 1.

Referring specifically to the drawings, a frame 10 is provided for supporting a partition panel. Frame 10 includes opposed top and bottom frame members 12 and 14, respectively, of equal length, and opposed side frame members 16 and 18, also of equal length. Each of the frame perimeter members has an extended end, 13, 15, 17, and 19, respectively. It will be noted that the extended ends are preformed with rounded corners so that the finished frame has rounded corners, throughout. The side, top and bottom frame members are affixed to each other by means of corner gussets 20 which are spot welded in place, preferably inside of the channels of the U-shaped frame members. A sound-deadening material such as fiberglass 22 is positioned inside the perimeter of the frame. Expanded metal grid 24 is spot welded to each side of the frame elements to provide the frame with torsional strength, and to hold fiberglass layer 22 in place.

Figure 4:
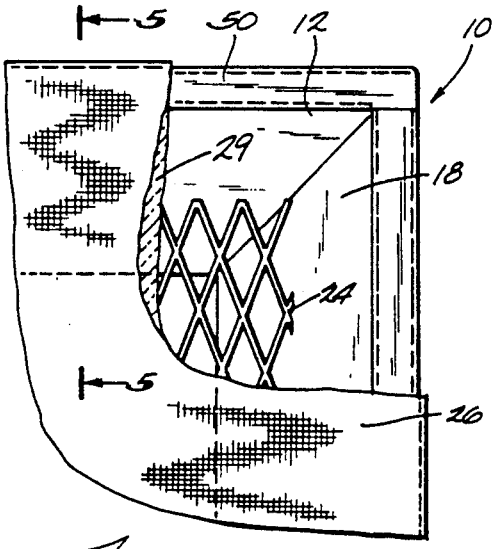
FIG. 4 is a fragmentary side view of the corner showing the corner of the panel frame of the present invention with fabric covering and fiberglass layer in place, but partially broken away.
Figure 5:
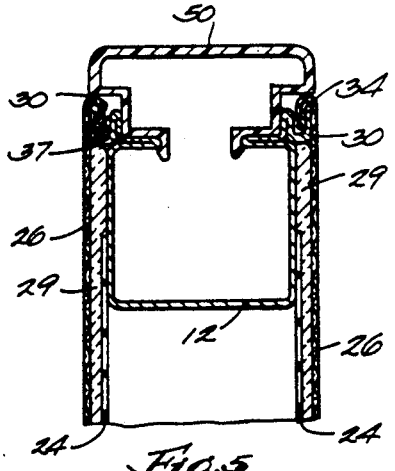
FIG. 5 is a cross-sectional view taken along line 5—5 of FIG. 4.

Referring to FIGS. 4 and 5, the cross-section of each U-shaped frame member is provided at each edge with a groove 30 adapted to receive and hold in place the edge 28 of fabric 26. As seen in FIG. 4, frame 10 is provided with a facing layer of fabric 26 or similar material such as vinyl sheeting or the like. In a preferred embodiment, a layer 29 of sound absorbing material such as fiberglass is applied over the layer of expanded metal.

Figure 7:
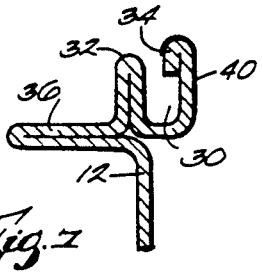
FIG. 7 is a broken away end view of a corner of a frame member showing the fabric-retaining groove thereof; and, FIG. 8 is a fragmentary side elevational view of a typical partitional wall formed of several panels of the present invention.
Figure 6:
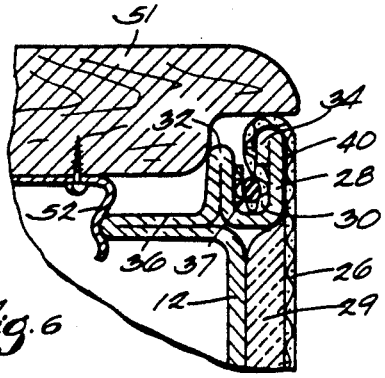
FIG. 6 is an expanded view showing the corner of the partition assembly of FIG. 5 with a different embodiment of a decorative perimeter cap in place.

As seen in FIGS. 6 and 7, each welting channel 30 is formed by crimping the edges of channel member 12 to form an inwardly extending ledge or projection 36 along the length thereof and an upwardly extending edge 32 which forms one side of channel 30 with the other side being formed by an inwardly folded edge or hem 34 of the metal. Welting 37, which may be, for example a rubber or plastic strip or fabric cord, can be used to hold the edge 28 of fabric 26 in channel 30, as best seen in FIG. 6. As seen in FIGS. 6 and 7, a layer of plastic tape 40 is adhered over the portion of the frame 12 with which fabric 26 comes in contact. Such tape is applied to protect the fabric from the effects of corrosion or oxidation of the roll formed steel.

Figure 8:
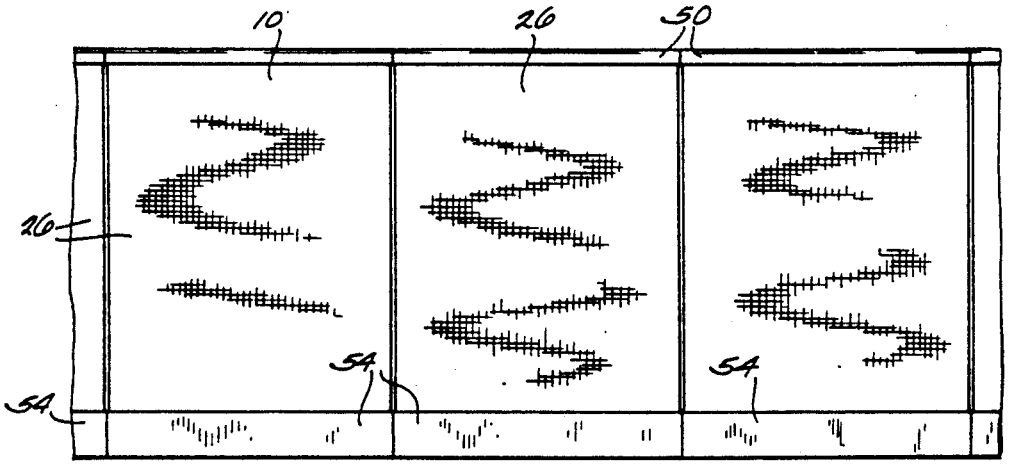

A perimeter cap 50 or 51 of conventional design can be readily secured to the edges of projections 36. As seen in FIG. 5, an extruded plastic cap 50 can be attached by snapping into place between projections 36. As seen in FIG. 6 a wood cap 51 can be attached by means of clips 52. As seen in FIG. 8, a plurality of panels 10 are assembled, if desired, to form a partition wall supported on conventional piece elements 54 which may be clamped or otherwise affixed to the bottom of each of the partition panel members.

The frame members, as illustrated, can readily be manufactured on conventional roll forming equipment, from cold rolled steel, for example, 18 gauge steel. The design of the corner joints, with one of the joint members extended beyond the miter joint, allows a preformed radius to be formed on each corner. The joint design also allows tolerance variations which occur in the manufacture of metal parts to be absorbed without creating an unacceptable offset of the frame members in each corner.

The panel frame is assembled by resistance welding the gusset brackets into each corner while holding the same in a sizing fixture. The expanded metal grid material is also resistance welded to each side of the frame in such a fixture. It will be noted that the welting grooves are designed with the hem of metal ending inside of the groove to form an undercut which allows the welting and fabric to be forced into the groove but does not readily allow the welting end fabric to be pulled back out of the groove.

It will be apparent from the foregoing description that the partition frame and assembled partitions provided by the present invention fulfill the foregoing objects of the invention various modifications within the spirit of the invention will be apparent to those skilled in the art.

What is claimed is:

1. A frame for an acoustical divider panel comprising:

top and bottom frame members of equal length, opposed side frame members of equal length joined at their ends by a miter joint to the ends of said top and bottom members to form a rectangular frame, each of said four members being formed of a U-shaped channel opening outwardly from said frame, said channel having outer edges formed into the shape of outwardly facing grooves extending along the length thereof for receiving the edges of a sheet of fabric, the interiors of said grooves containing an undercut portion adapted to secure the edge of said fabric therein, each of said frame members being formed from a single sheet of metal bent into the form of said U-shaped channel, the outer edges on each side of each of said channels being formed by a series of folds into the shape of said grooves.

2. A frame according to claim 1 wherein one of the abutting frame members at each of said miter joints has an extended outer edge, whereby the amount of offset between said adjoining members can be adjusted.

3. A frame according to claim 1 wherein each of said frame members is formed from cold rolled sheet metal.

4. A frame according to claim 3 wherein said undercuts are formed by folding the edges of said metal into the grooves a portion of the depth of said grooves.

5. A frame according to claim 4 wherein each side of each of said channels is provided with an inwardly projecting ledge formed by a fold in said metal.

6. A frame according to claim 5 wherein the frame members are attached to each other by corner gussets spot welded thereto and an expanded metal grid is spot welded to each side of said frame.

7. An acoustical divider panel comprising:

top and bottom frame members of equal length, opposed side frame members of equal length joined at their ends by a miter joint to the ends of said top and bottom members to form a rectangular frame, each of said four members being formed of a U-shaped channel opening outwardly from said frame, each of said frame members being formed from a single sheet of metal bent into the form of said U-shaped channel, the outer edges on each side of each of said channels being formed by a series of folds into the shape of outwardly facing grooves extending along the length thereof for receiving the edges of a sheet of fabric, the interiors of said grooves containing an undercut portion adapted to secure the edge of said fabric therein, said undercuts being formed by folding the edges of said metal into the grooves a portion of the depth of said grooves, a layer of sound absorbing material filling the space enclosed by said frame, means to retain said sound-absorbing material in said space, and, a layer of decorative facia material covering each side of the panel, the edges of said facia material being retained in said grooves.

8. A panel according to claim 7 wherein one of said abutting frame members at each of said miter joints has an extended outer edge, whereby the amount of offset between said adjoining members can be adjusted.

9. A panel according to claim 7 wherein each of said frame members is formed from cold rolled sheet metal.

10. A panel according to claim 9 wherein said undercuts are formed by folding the edges of said metal into the grooves a portion of the depth of said grooves.

11. A panel according to claim 10 wherein each side of each of each of said channels is provided with an inwardly projecting ledge formed by a fold in said metal.

12. A panel according to claim 11 wherein the frame members are attached to each other by corner gussets spot welded thereto and an expanded metal grid is spot welded to each side of said frame.

13. A panel according to claim 12 wherein said decorative facia material is a cloth fabric, the edges of which are wedged in said grooves together with a welting.

14. A panel according to claim 13 wherein a layer of sound absorbing material is positioned between the metal grid and the fabric facia material.

* * * * *

UNITED STATES PATENT AND TRADEMARK OFFICE

CERTIFICATE OF CORRECTION

PATENT NO. : 5,086,606

DATED : February 11, 1992

INVENTOR(S) : Gregory R. Finses

It is certified that error appears in the above-indentified patent and that said Letters Patent is hereby corrected as shown below:

Column 4, lines 31 and 32:

After "comprising:" indent and insert the following:

--- a frame formed from: ---.

Signed and Sealed this

Third Day of August, 1993

*Attest:*

Michael K. Kirk

MICHAEL K. KIRK

*Attesting Officer*

*Acting Commissioner of Patents and Trademarks*